US006207250B1

(12) United States Patent
Bullock et al.

(10) Patent No.: US 6,207,250 B1
(45) Date of Patent: Mar. 27, 2001

(54) TREATED TEXTILE FABRIC

(75) Inventors: Kyle Bullock, Forest City, NC (US); Craig A. Rubin; Randy B. Rubin, both of Franklin, MI (US)

(73) Assignee: Hi-Tex, Inc., Farmington Hills, MI (US)

( * ) Notice: Subject to any disclaimer, the term of this patent is extended or adjusted under 35 U.S.C. 154(b) by 0 days.

(21) Appl. No.: 09/050,514

(22) Filed: Mar. 30, 1998

Related U.S. Application Data

(63) Continuation-in-part of application No. 08/687,527, filed on Aug. 7, 1996.

(51) Int. Cl.[7] ..... B32B 3/10

(52) U.S. Cl. ..... 428/137; 428/907; 428/908.8; 156/230; 427/261; 427/288; 427/389.9

(58) Field of Search ..... 427/261, 288, 427/322, 407, 389.9; 8/2.5, 118, 115.5, 127.6, 128 R, 495; 428/265, 907, 908.8; 156/230

(56) References Cited

U.S. PATENT DOCUMENTS

| | | | | |
|---|---|---|---|---|
| 3,023,072 | * | 2/1962 | Dabrowski et al. | 8/82 |
| 3,111,361 | | 11/1963 | Fang . | |
| 3,238,010 | | 3/1966 | Habib et al. . | |
| 3,419,533 | | 12/1968 | Dieterich . | |
| 3,479,310 | | 11/1969 | Dieterich . | |
| 3,521,993 | | 7/1970 | Swidler et al. . | |
| 3,652,198 | | 3/1972 | Farber et al. . | |
| 3,713,878 | * | 1/1973 | Thomas | 117/135.5 |
| 3,922,399 | * | 11/1975 | Ochsner | 427/288 |
| 4,027,062 | | 5/1977 | Engelbrecht et al. . | |
| 4,108,814 | | 8/1978 | Reiff et al. . | |
| 4,113,432 | | 9/1978 | Otto . | |
| 4,183,836 | | 1/1980 | Wolfe, Jr. . | |
| 4,189,429 | | 2/1980 | Lambert, Jr. . | |
| 4,203,883 | | 5/1980 | Hangauer, Jr. . | |
| 4,256,459 | | 3/1981 | Russell et al. . | |
| 4,365,968 | | 12/1982 | Gregorian et al. . | |
| 4,408,008 | | 10/1983 | Markusch . | |
| 4,496,363 | * | 1/1985 | De Filippi | 8/115.5 |
| 4,507,413 | | 3/1985 | Thoma et al. . | |
| 4,507,430 | | 3/1985 | Shimada et al. . | |
| 4,518,649 | | 5/1985 | Wang et al. . | |
| 4,594,286 | | 6/1986 | McKinney et al. . | |
| 4,598,120 | | 7/1986 | Thoma et al. . | |
| 4,721,511 | | 1/1988 | Kupits . | |
| 4,775,384 | | 10/1988 | Bachem et al. . | |
| 4,795,675 | | 1/1989 | Dunn, Jr. et al. . | |
| 4,833,006 | | 5/1989 | McKinney et al. . | |
| 4,835,019 | | 5/1989 | White et al. . | |
| 4,844,952 | | 7/1989 | Korenkiewicz et al. . | |
| 4,861,501 | | 8/1989 | Pfeifer . | |
| 4,889,765 | | 12/1989 | Wallace . | |
| 4,901,389 | | 2/1990 | Poulenard et al. . | |
| 4,921,756 | | 5/1990 | Tolbert et al. . | |
| 4,996,099 | | 2/1991 | Cooke et al. . | |
| 5,009,667 | | 4/1991 | Beck et al. . | |
| 5,091,243 | | 2/1992 | Tolbert et al. . | |
| 5,126,138 | | 6/1992 | McGee et al. . | |
| 5,126,183 | * | 6/1992 | McGee et al. | 424/404 |
| 5,177,141 | | 1/1993 | Thoma et al. . | |
| 5,194,667 | | 3/1993 | Oxenrider et al. . | |
| 5,196,080 | | 3/1993 | Mizobuchi et al. . | |
| 5,306,764 | | 4/1994 | Chen . | |
| 5,565,265 | * | 10/1996 | Rubin et al. | 428/265 |
| 5,747,392 | | 5/1998 | Xiao et al. . | |

FOREIGN PATENT DOCUMENTS

| | | |
|---|---|---|
| 32 31 062 A1 | 2/1984 | (DE) . |
| 34 15 920 A1 | 11/1985 | (DE) . |
| 38 36 030 A1 | 5/1990 | (DE) . |
| 0 097 995 A2 | 1/1984 | (EP) . |
| 0 525 671 A1 | 2/1993 | (EP) . |
| 1-97274 | 4/1989 | (JP) . |
| 3-195737 | 8/1991 | (JP) . |
| 6-31845 | 2/1994 | (JP) . |
| 6-108365 | 4/1994 | (JP) . |

OTHER PUBLICATIONS

John C. Tsirovasiles et al, *The Use of Water–Borne Urethane Polymers in Fabric Coatings*, J. Coated Fabrics (1986), Oct. 16, pp. 114–22.

Joseph W. Weinberg, *Performance And Application Advantages of Waterborne systems In The Automotive And Textile Industries*, J. Industrial Fabrics (1986) 4(4), pp. 29–38 (No month).

* cited by examiner

*Primary Examiner*—Merrick Dixon
(74) *Attorney, Agent, or Firm*—Brooks & Kushman P.C.

(57) ABSTRACT

A liquid repellant, stain-resistant, antimicrobial fabric. At least one composition comprising an antimicrobial agent and a fluorochemical composition is applied to a fabric such as a jacquard, to produce a treated fabric. The liquid and stain-resistant, antimicrobial, fabric essentially retains its natural texture, is durable and is easy to handle.

22 Claims, No Drawings

TREATED TEXTILE FABRIC

This application is a continuation-in-part of U.S. patent application Ser. No. 08/687,527, filed Aug. 7, 1996, entitled "Treated Textile Fabric", which is hereby incorporated by reference.

FIELD OF THE INVENTION

The present invention relates to treated textile fabric and to a method treating a fabric. The present invention more particularly relates to a method of preparing a liquid and stain resistant, antimicrobial textile fabric, and to the fabric so prepared.

BACKGROUND OF THE INVENTION

Stain resistance, water repellency and resistance to microbial growth are important in many uses of textile materials. In restaurants, for example, table cloths and seating upholstery often lack stain resistance and are subject to rapid water penetration. These properties necessitate frequent cleaning and/or replacement of such items. Although one generally views microbial growth as associated with fibers of biologic origin such as cotton, wool, linen and silk, in the field of marine use, the high relative humidity renders even synthetic polymer textiles, such as polyesters and polyamides, subject to microbial growth, which is also true of many other outdoor uses.

The term "water repellant" as used herein means essentially impermeable to water, i.e. treated textile can support a considerable column of water without water penetration through the fabric. Such behavior is sometimes termed "water resistant." However, the last term generally implies a lesser degree of water repellency and further can be confused with the chemical use of "water resistant" to refer to coatings which are chemically stable to water or which will not be washed off by water. Hydrophobicizing topical treatments are incapable of providing the necessary degree of water repellency as that term is used herein.

Textile fabrics may be made water repellant by various processes. For example, textile fabrics may first be scoured with a soap solution and then treated with a composition which may include zinc and calcium stearates as well as sodium soaps. The long chain carboxylic acid hydrophobic compounds provide a limited amount of water repellency. It is also possible to render fabrics liquid resistant by treating the fabric with commercially available silicone, for example poly(dimethylsiloxane).

To overcome problems associated with water absorption and stain resistance, resort has been made to synthetic leathers and polyvinylchloride (vinyl) coated fabrics. However, these fabrics do not have the hand or feel of cloth. Moreover, although attempts have been made to render such materials water vapor permeable, these attempts have met with only very limited success, as evidenced by the failure of synthetic leather to displace real leather in high quality seating and footwear.

Applications of relatively small amounts of fluorochemicals such as the well known SCOTCHGUARD™ and similar compounds also may confer a limited degree of both water repellency and stain resistance. However, for optimal water repellency, it has proven necessary to coat fabrics with thick polymeric coatings which completely destroy the hand and feel of the fabric. Examples include vinyl boat covers, where the fabric backing is rendered water resistant by application of considerable quantities of polyvinylchloride latex or the thermoforming of a polyvinyl film onto the fabric. The fabric no longer has the hand and feel of untreated fabric, but is plastic-like. Application of polyurethane films in the melt has also been practiced, with similar results. However, unless aliphatic isocyanate-based polyurethanes are utilized, the coated fabric will rapidly weather.

It would be desirable to provide a fabric that allows water vapor to pass through the fabric while prohibiting the passage of liquid. It would also be desirable to provide a method of producing a liquid repellant, stain resistant, antimicrobial fabric. It would further be desirable to provide a liquid repellant, stain resistant, antimicrobial fabric that retains its natural hand and texture, is easy to handle, and economical to produce.

SUMMARY OF THE INVENTION

The present invention provides a water repellant, stain resistant, antimicrobial fabric that feels like fabric rather than plastic. The fabric of the present invention is treated with at least one treatment composition comprising both antimicrobial agent(s) and fluorochemical(s) to provide a water repellant, stain resistant, antimicrobial fabric.

BEST MODES FOR CARRYING OUT THE INVENTION

The water repellant, stain resistant, antimicrobial, fabric of the present invention retains its natural "hand" or texture and is therefore aesthetically and texturally appealing. The fabric of the present invention is also durable, easy to handle and economical to produce.

The fabrics useful in the present invention include, but are not limited to, woven, non-woven and knitted fabrics, and preferably yarn or piece dyed upholstery woven fabrics, of natural fibers, synthetic fibers and mixtures of natural and synthetic fibers. Suitable natural fibers include, but are not limited to, fibers of cotton, linen, ramie, silk, wool and the like. Suitable synthetic fibers include, but are not limited to, fibers of nylon, polyester, acrylic, rayon, acetate and the like. Suitable fabrics for use with the present invention include, but are not limited to, jacquards (i.e., fabrics manufactured from a jacquard loom), brocades, dobbys (i.e., fabrics manufactured from a dobby loom) and canvases.

The treating process of the subject invention involves, in a first step, treating the fabric with a penetrating topical composition, hereinafter referred to as the primary treatment composition. The primary treatment composition in its most basic nature, comprises a fluorochemical treating agent in substantial amount, one or more antimicrobial agents, such as microbicidides and/or mildewcides, and water. The nature of the primary treatment composition is such that the fabric is thoroughly treated by topically treating the fabric, the primary treatment composition covering equally well both sides (i.e., surfaces) of the fabric as well as pentrating the surfaces of the fabric to cover the interstitial spaces within the fabric. The fabric is then oven dried at elevated temperatures, for example, from 250° F. to 350° F. (121° C. to 177° C.), resulting in a primarily treated fabric. The primarily treated fabric is mildew resistant, stain resistant and water repellant. In addition, its tensile and tear strengths are markedly improved. Yet, the primarily treated fabric is very difficult to distinguish from untreated fabric by hand, feel, texture, or ease of handling.

Although the process described above creates a unique new textile material, the new textile material is generally not completely water repellant. Inspection of the primarily treated fabric against a light source reveals multitudinous "pinholes" which may ultimately allow water to pass through the fabric. To render the primarily treated fabric water repellant, one or more additional coating steps, or secondary treatments, may be necessary, depending on the degree of water repellency desired. The additional steps, if more than one, are the same, and involve the application of a high solids polymeric latex, containing an emulsion polymer with a glass transition temperature ($T_g$) of between −45° C. and 0° C., to one side of the primarily treated fabric. The latex, which has a consistency that is similar to that of wallpaper paste or high solids wood glue, is rolled, sprayed, or otherwise applied to the primarily treated fabric which then passes under a knife blade, doctor blade, or roller that essentially contacts the primarily treated fabric surface, leaving a thin coating of about 1–5 oz/yd$^2$, and preferably about 1.5 oz/yd$^2$, of material. The coated primarily treated fabric is then oven dried at 250° F. to 350° F. (121° C. to 277° C.) resulting in a secondarily treated fabric.

The resulting secondarily treated fabric still retains excellent hand and feel, although being less drapeable than the untreated virgin fabric. Inspection against a light shows very few pinholes, which application of a somewhat thicker coating may further reduce. However, even with the relatively few pinholes, the secondarily treated fabric is virtually completely water repellant, and is able to support a considerable column of water without leakage. If further water repellency is required, this secondary treatment may be repeated.

The processes of treating textile fabric and the properties of the treated fabric in accordance with the present invention may be further understood in relation to the following detailed description. It should be understood that the term "weight percent", as used with respect to the components of the compositions of the present invention, refers to the total weight of the components of the compositions of the present invention and not to the weight percents of the solids or polymers in the components of the compositions of the present invention, unless otherwise specified.

The first step in the process of treating fabric in accordance with the present invention involves the application of primary treatment composition to the fabric, hereinafter referred to as the primary treatment. The primary treatment is then followed by oven drying resulting in the primarily treated fabric.

The primary treatment composition minimally contains the following components: an antimicrobial agent; a fluorochemical textile treating agent; and water. In preferred embodiments, the primary treatment composition may further include a crosslinking agent, a fire retardant and/or smoke suppressant, and other additives and auxiliaries such as dispersants, thickeners, dyes, pigments, ultraviolet light stabilizers, and the like. It would not depart from the spirit of the invention to include a minor amount of a dispersible polymer latex. However, the viscosity of the primary treatment must be low enough that thorough penetration of the fabric is obtained.

The antimicrobial agent preferably comprises from about 0.25 to about 4 weight percent of the primary treatment composition, based on the weight of the primary treatment composition, and more preferably from about 0.40 to about 2 weight percent, and most preferably about 0.60 weight percent. By "antimicrobial agent" is meant any substance or combination of substances that kills or prevents the growth of a microorganism, and includes antibiotics, antifungal, antiviral and antialgal agents. The most preferred antimicrobial agent is ULTRAFRESH™ DM-25, available from Thomas Research. Another preferred antimicrobial agent is AMICAL FLOWABLE™, available from Angus Chemical Company of Northbrook, Ill. Other antimicrobials, particularly fungicides, may be used. Suitable examples include, but are not limited to, various tin compounds, particularly trialkyltin compounds such as tributyl tin oxide and tributyl tin acetate, copper compounds such as copper 8-quinolinolate, metal complexes of dehydroabietyl amine and 8-hydroxyquinolinium 2-ethylhexoate, copper naphthenate, copper oleate, and organosilicon quarternary ammonium compounds.

The fluorochemical textile treating agent comprises from about 5 to about 20 weight percent of the primary treatment composition, based on the weight of the primary treatment composition, more preferably from about 6 to about 12 weight percent, and most preferably about 10 weight percent. The fluorochemicals provide water repellency and stain resistance and may comprise unbranded generic fluoropolymers. Suitable fluorochemical treating agents include, but are not limited to, the commercially available fluorochemical compositions SCOTCHGUARD™ FC 255, SCOTCHGUARD™ FC 214-230, available from 3M, and TEFLON™ RN, TEFLON™ 8070, and TEFLON™ 8787, available from E. I. Dupont de Nemours, and mixtures thereof. TEFLON™ 8070 is the most preferred fluorochemical treating agent for use in the primary treatment composition. The fluorochemical treating agent typically comprises from about 5 to about 25 weight percent solids, based on the weight of the fluorochemical treating agent, and preferably comprises from about 8 to about 15 weight percent solids, and most preferably comprises about 12 weight percent solids. It is noteworthy that the amount of fluorochemical treating agent used in the primary treatment composition is considerably higher than traditionally used for treating upholstery fabric to render it stain resistant.

Crosslinking agents suitable for use in the primary treatment composition include resins which are themselves crosslinkable. Preferred self-crosslinking resins are the various melamine/formaldehyde and phenol/formaldehyde resins and their variants. The most preferred self-crosslinking agent is WT-50™, a product of the B. F. Goodrich Company comprising about 80 weight percent solids and 20 weight percent water. Suitable other self-crosslinking resins include, but are not limited to, phenol, melamine, urea, and dicyandiamide based formaldehyde resins, which are available commercially, for example, from the Borden Chemical Company of Columbus, Ohio. Preferably the self-crosslinking agent is present in the primary treatment composition in an amount of from about 0.1 to about 3.0 weight percent, based on the weight of the primary treatment composition, and more preferably in an amount of less than about 1.0 weight percent. Most preferably, the self-crosslinking agent is WT-50™ and is present in the primary treatment composition in an amount of about 0.25 weight percent, based on the weight of the primary treatment composition. Other crosslinkable resins such as oligomeric unsaturated polyesters, mixtures of polyacrylic acid and polyols, e.g. polyvinylalcohol, and epoxy resins may also be used, together with any necessary catalysts to ensure crosslinking during the oven drying cycle.

The primarily treated fabrics produced by the subject process can have flame retardants and/or smoke suppressants added to them to improve the flame retardency of the fabrics. Suitable flame retardants are known to those skilled in the art of fabric finishing, and include, for example, cyclic phosphorate esters such as Antiblaze™ 19T available from Mobil Chemical Co.

The order of mixing the components of the primary treatment composition is not very critical. In general, the antimicrobial agent, the fluorochemical treating agent, the crosslinking agent and any other ingredients are added to water in any order. The mixture is stirred until a uniform dispersion is obtained. The water is present in the primary treatment composition in an amount of from about 70 to about 95 weight percent, based on the weight of the primary treatment composition, and more preferably from about 85 to about 90 weight percent, and most preferably about 89 weight percent.

The fabric to be primarily treated may be drawn through a bath of the primary treatment composition by any convenient method, or the primary treatment composition may be sprayed or rolled onto the fabric. Preferably, the fabric, previously scoured to remove textile yarn finishes, soaps, etc., is drawn through a bath of the primary treatment composition, as the topical composition of the first treating step should uniformly coat both surfaces of the fabric as well as its interior. The fabric, after being drawn through a bath of the primary treatment composition, may be passed through nips or nip rollers to facilitate more thorough penetration of the primary treatment composition into the fabric and/or to adjust the amount of the primary treatment composition relative to the fabric. By such or other equivalent means, the pickup is adjusted to provide from about 30 to about 200 weight percent pickup relative to the weight of the untreated fabric, more preferably from about 60 to about 150 weight percent, and most preferably from about 80 to about 120 weight percent. About a 100 weight percent addition of primary treatment composition relative to the weight of the untreated fabric is considered optimal with normal primary treatment composition solids content.

The coated fabric is then passed through an oven maintained at an elevated temperature, preferably from 250° F. to 350° F. (121° C. to 277° C.) for a period of time sufficient to cure the applied primary treatment composition. By the term "cure", as used in the previous sentence, it is meant to dry the applied primary treatment composition, and, if the first treatment step is not to be followed by additional primary treatments, to perform any necessary crosslinking of the components of the primary treatment composition. Generally, a period of from 1 to 8 minutes, preferably about 2 minutes at 325° F. (163° C.) is sufficient.

The primarily treated fabric of the subject invention has a number of advantageous and unique characteristics. It is highly, although not totally, water repellant, as well as being stain resistant. While highly water repellant, the primarily treated fabric allows ready passage of water vapor, and is thus eminently suited for items such as boat covers, which have traditionally been made of vinyl-coated fabrics. The vinyl-coated fabrics are substantially water vapor impermeable, and contribute to mildew formulation in boats using such covers. The primarily treated fabric has substantially the same hand, feel, texture, and drape of uncoated fabric, and thus can be manipulated by traditional manufacturing techniques as well as being aesthetically pleasing. The primarily treated fabric is also considerably more resistant to tear and opening at needle holes, as well as having higher tensile strength.

For more complete water repellency, one or more subsequent secondary treatments are utilized. The secondary treatment compositions utilized for the second and any subsequent treatments are different from that of the primary treatment composition, although the primary treatment may be repeated as well. The second and any subsequent treatments are designed to increase stain resistance and also to render the fabric virtually totally water repellant.

The secondary treatment composition minimally comprises a copolymer latex, one or more antimicrobial agents and a fluorochemical textile treatment agent. The secondary treatment composition comprises from about 30 to about 70 weight percent solids, based on the weight of the secondary treatment composition, and preferably from about 40 to about 60 weight percent solids, and most preferably from about 40 to about 50 weight percent solids.

The copolymer of the copolymer latex of the secondary treatment composition has a glass transition temperature of 0° C. or lower, preferably −10° C. or lower, and preferably within the range of −40° C. to −10° C., and is preferably a styrene/acrylate copolymer. A preferred styrene/acrylate copolymer latex is Hycar™ 0202, a copolymer latex comprising about 50 weight percent solids which is available from the B. F. Goodrich Company of Akron, Ohio. The secondary treatment composition contains from about 30 to about 80 weight percent copolymer latex, based on the weight of secondary treatment composition, and preferably, from about 40 to about 70 weight percent, and more preferably about 55 to about 62 weight percent, and most preferably about 61 weight percent. The copolymer latex comprises from about 30 to about 70 weight percent solids, based on the weight of the copolymer latex, preferably from about 40 to about 60 weight percent solids, and most preferably about 50 weight percent solids.

Thickeners are generally necessary to adjust the rheological properties of the secondary treatment composition. Such thickeners are well known, and include water soluble, generally high molecular weight natural and synthetic materials, particularly the latter. Examples of natural thickeners include the various water soluble gums such as gum acacia, gum tragacanth, guar gum, and the like. More preferred are the chemically modified celluloses and starches, such as methycellulose, hydroxymethylcellulose, propylcellulose, and the like. Most preferred are high molecular weight synthetic polymers such as polyacrylic acid; copolymers of acrylic acid with minor amounts of copolymerizable monomers such as methyl acrylate, methacrylic acid, acrylonitrile, vinylacetate, and the like, as well as the salts of these compounds with alkali metal ions or ammonium ions; polyvinylalcohol and partially hydrolyzed polyvinylacetate; polyacrylamide; polyoxyethylene glycol; and the so-called associative thickeners such as the long chain alkylene oxide capped polyoxyethylene glycols and polyols or their copolymer polyoxyethylene/polyoxypropylene analogues. The length of the carbon chain of the long chain alkylene oxide in associative thickeners has a great effect on the thickening efficiency, with alkylene residues of 8–30 carbon atoms, preferably 14–24 carbon atoms having great thickening efficiency. Examples of some preferred acrylic thickeners are ASC95™ and TT615™, both of which are available from the Rohm and Haas Co., of Philadelphia, Pa. The thickener may be used in amounts up to 12 weight percent, based on the weight of the secondary treatment composition, and more preferably from about 6 weight percent to about 10 weight percent, and most preferably about 8 weight percent or less. In contrast to the copolymer latex, in which the solids are dispersed, the thickener solids are water soluble in the amounts used.

The secondary treatment composition may further contain from about 4 to about 20 weight percent, of a fluorochemical textile treating agent, based on the weight of the secondary treatment composition, and preferably about 5 to about 15 weight percent, more preferably about 6 to about 10 weight percent and most preferably about 6 weight percent. Fluorochemical treatment agents suitable for use with the secondary treatment composition include the fluorochemical treatment agents suitable for use with the primary treatment composition identified above. TEFLON™ RN is the most preferred fluorochemical treating agent for use in the secondary treatment composition. It is noteworthy that the amount of fluorochemical treating agent used in the secondary treatment composition is considerably higher than amounts traditionally used for treating upholstery fabric to render it stain resistant.

The secondary treatment composition may also include one or more antimicrobial agents in an amount of from about 0.1 to about 2 weight percent, based on the weight of the secondary treatment composition, and preferably from about 0.2 to about 1 weight percent, and more preferably about 0.4 weight percent. Antimicrobial agents suitable for use with the secondary treatment composition include the antimicrobial agents suitable for use with the primary treatment composition identified above. Most preferably the secondary treatment composition contains about 0.2 weight percent each of ULTRAFRESH™ DM-25 available from Thompson Research and AMICAL FLOWABLE™ available from Angus Chemical Company.

The secondary treatment composition may also include a pH adjuster. Suitable pH adjusters include ammonium compositions such as ammonium hydroxide and zinc ammonium carbonate. When a pH adjuster is used in the secondary treatment composition, it is desirable that it be present in the secondary treatment composition in an amount of no more than about 5 weight percent, based on the weight of the secondary treatment composition. Preferably the pH adjuster is present in the secondary treatment composition in an amount of less than about 2.5 weight percent, based on the weight of the secondary treatment composition. Most preferably, the pH adjuster is ammonium hydroxide and is present in the secondary treatment composition in an amount of about 1.8 weight percent, based on the weight of the secondary treatment composition. Addition of pH adjusters may augment the thickening ability of polyacrylic acid and similar thickeners.

The secondary treatment composition may also include a crosslinking catalyst. Suitable catalysts include zirconium acetate, zinc ammonium carbonate, ammonium chloride, ammonium nitrate and para-toluene sulfonic acid. When a catalyst is used in the secondary treatment composition, it is desirable that it be present in the secondary treatment composition in an amount of no more than about 5 weight percent, based on the weight of the secondary treatment composition. Preferably the catalyst is present in the secondary treatment composition in an amount of from about 0.5 to about 2 weight percent, based on the weight of the secondary treatment composition. Most preferably, the catalyst is zirconium acetate and is present in the secondary treatment composition in an amount of about 0.75 weight percent, based on the weight of the secondary treatment composition.

The secondary treatment composition may also include a self-crosslinking resin. Suitable self-crosslinking resins include the self-crosslinking resins useable with the primary treatment composition identified above. When a self-crosslinking resin is used in the secondary treatment composition, it is desirable that it be present in the secondary treatment composition in an amount of no more than about 5 weight percent, based on the weight of the secondary treatment composition. Preferably the self-crosslinking resin is present in the secondary treatment composition in an amount of from about 0.5 to about 2 weight percent, based on the weight of the secondary treatment composition. Most preferably, the self-crosslinking resin in the secondary treatment composition is WT-50™ and is present in the secondary treatment composition in an amount of about 1.1 weight percent, based on the weight of the secondary treatment composition.

The secondary treatment composition may also include any detackifying filler capable of detackify the finish of the secondarily treated fabric. Suitable detackifying fillers include felspar slurry, aluminum trihydrate, calcium carbonate, clay and barium sulfate. When a detackifying filler is used in the secondary treatment composition, it is desirable that it be present in the secondary treatment composition in an amount of no more than about 25 weight percent, based on the weight of the secondary treatment composition. Preferably the detackifying filler is present in the secondary treatment composition in an amount of from about 8 to about 20 weight percent, based on the weight of the secondary treatment composition. Most preferably, the detackifying filler is a 65 weight percent solid aqueous felspar slurry manufactured from E. I. DuPont de Nemours and is present in the secondary treatment composition in an amount of about 16.4 weight percent, based on the weight of the secondary treatment composition.

The secondary treatment composition may also include a detackifying wax to detackify the finish of the secondarily treated fabric. Suitable detackifying waxes include any suitable waxes which are capable of detackifying the finish of the fabric of the present invention, such as paraffin wax, zirconium wax and microcrystalline waxes. Preferably, the detackifying wax is present in the secondary treatment composition in the form of an aqueous wax emulsion containing from about 35 to about 70 weight percent wax, based on the weight of the wax emulsion. When a detackifying wax emulsion is used in the secondary treatment composition, it is desirable that it be present in the secondary treatment composition in an amount of no more than about 15 weight percent, based on the weight of the secondary treatment composition. Preferably the detackifying wax emulsion is present in the secondary treatment composition in an amount of about 3 to about 8 weight percent, based on the weight of the secondary treatment composition. Most preferably, the detackifying wax emulsion is a paraffin wax emulsion, comprising about 50 weight percent solids, and is available from Cross-link Inc., of Cliffside, N.C., and is present in the secondary treatment composition in an amount of about 4 weight percent, based on the weight of the secondary treatment composition.

Flame retardants which are dispersible may be added to the secondary treatment composition in the place of or in addition to those previously described with respect to the primary treatment composition. An example is Caliban™ P-44, containing decabromodiphenyloxide and antimony oxide available from White Chemical Company. A suitable smoke suppressant is zinc borate, which may be used in the amount of 2 weight percent based on solids.

The order of mixing the components of the secondary treatment composition is not very critical. In general, the components are added to the copolymer latex in any order, with thickeners usually being added last. The mixture is stirred until a uniform composition is obtained. The resulting composition is considerably more viscous than the primary treatment composition, and has a consistency similar to that of PVA wood glue or wallpaper paste. It will be appreciated that the secondary treatment composition could further include other additives and auxiliaries such as dispersants, dyes, pigments, ultraviolet light absorbers, and the like.

Unlike the primary, topical treatment, which is applied to both sides of the fabric by virtue of immersion in a bath, the second and subsequent treatments are applied to one side of the fabric only, the side which is not to be exposed to the environment.

The amount of the secondary treatment applied may vary. Preferably, a doctor blade or knife edge is adjusted to touch or nearly touch the fabric surface as the fabric, coated with the secondary treatment composition, passes by. The coating may be as much as 1 mm thick above the fabric. When subsequently dried, the thickness of the coating will, of course, be considerably reduced.

It is of great importance that the primary treatment precede the secondary or subsequent treatment(s). The primary treatment interferes with the penetration of the secondary treatment composition into the fabric, and thus limits the amount of secondary treatment composition which the fabric can contain at a given knife blade setting. It is believed that the inability of the secondary treatment composition to substantially penetrate into the fabric assists in maintaining the hand and feel of the fabric of the present invention, which otherwise would be stiff and boardy.

Following the secondary treatment, the fabric again is oven dried, at temperatures from 250° F. to 350° F. (121° C. to 277° C.), preferably 300 to 350° F. (149° C. to 277° C.) for a period of time sufficient to cure the applied secondary treatment composition. By the term "cure" as used in the previous sentence, it is meant to dry the applied secondary treatment composition, and if the secondary treatment is not to be followed by any subsequent treatments, to perform any necessary crosslinking of the components of the secondary treatment composition. As a result of the primary, secondary, and any subsequent treatments, the weight of the finished fabric will have generally increased by from 70% to 200%, preferably from 80% to about 150%, and particularly from 90% to 120%.

It will be appreciated by those skilled in the art that the amount of the copolymer composition, antimicrobial agent, fluorochemicals and additives may be varied depending on the desired result of the coating composition. For example, fabric of tighter weave may require only a primary treatment or a primary treatment and one secondary treatment whereas an open weave fabric may require primary treatment and two or more secondary treatments. It will also be appreciated that the combination of the various components of the composition of the present invention may be varied to achieve the desired result. For example, the concentration of the primary treatment composition, secondary composition, or both may be increased to reduce the overall number of treatments required.

As mentioned above, the fabric of the present invention is durable, easy to handle and economical to produce. Because the fabric of the present invention retains its "hand" or texture, the fabric is easy to sew and seams are less noticeable, and more durable. For example, when vinyl is sewed, the needle holes tend to open when the vinyl is stretched. With the fabric of the present invention, needle holes do not tend to open and thus the seams are stronger and less noticeable. Moreover, while the fabric of the present invention provides a moisture barrier, it is believed that vapors are allowed to pass through the fabric. Human skin which may come in contact with the fabric of the present invention, for example in upholstery applications, is therefore less likely to perspire.

The following Specific Examples further describes the present invention.

EXAMPLE 1

A previously dyed jacquard fabric is immersed into a bath of primary treatment composition containing 10.23 weight percent TEFLON™ 8070 fluorochemical, 0.25 weight percent WT-50™ melamine/formaldehyde resin, and 0.6 weight percent of ULTRAFRESH™ DM-25 biocide, and 88.92 weight percent water. The treated fabric is passed through nip rolls whose pressure is adjusted to provide for 100% primary treatment composition pickup. The fabric is then dried by passage through a drying oven. The resulting treated fabric displays virtually no change in color, is able to support a considerable column of water, indicating good water repellency, and is stain resistant. The resulting fabric is water vapor permeable, and has excellent hand, feel, and texture. The tear strength and tensile strength are considerably improved relative to the untreated fabric. Examination of the treated fabric against a strong light showed the presence of numerous pinholes.

EXAMPLE 2

A jacquard similar to that used in Example 1 is subjected to the primary treatment of Example 1. The primarily treated fabric, when viewed against a strong light, exhibits numerous pinholes, but is substantially water repellant. The primarily treated fabric is then coated with a secondary treatment composition containing 200 lbs of a 50 weight percent solids latex identified as HYCAR™ 0202 available from B. F. Goodrich; 3.75 lbs WT-50™ melamine/formaldehyde resin available from B. F. Goodrich; 2.5 lbs zirconium acetate; 20 lbs Teflon™ RN fluorochemical, available from E. I. DuPont de Nemours; 53.85 lbs of a 65 weight percent solids Felspar slurry; 6 lbs of ammonium hydroxide; 0.64 lb each of ULTRAFRESH™ DM-25 and AMICAL FLOWABLE™ biocides; and 14 lb of a 50 weight percent solid paraffin wax emulsion available from Cross-Link Inc. The secondary treatment composition has the consistency of wallpaper paste, after thickening with 27 lbs. of acrylic thickener.

The fabric, coated with excess secondary treatment composition on the undermost side only, is passed below a knife blade adjusted to contact the undermost surface of the fabric, removing excess secondary treatment composition. The fabric is then dried in a drying oven.

The resulting fabric is virtually totally water repellant, supporting a higher column of water than the same fabric after treatment with the primary treatment composition only. However, examination under a strong light shows evidence of occasional pinholes. The fabric has excellent hand and feel, although it is somewhat stiffer than the virgin fabric. The fabric has the appearance of fabric, not of plastic.

The same fabric is subjected to a subsequent treatment identical to the previous secondary treatment. Examination against a strong light shows no observable pinholes.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the specification and following claims.

What is claimed is:

1. A stain resistant and water repellant treated textile fabric, said fabric prepared by a process comprising:

a) selecting an untreated textile fabric;

b) topically treating said untreated fabric with an aqueous primary treatment composition comprising:

b)i) from about 0.25 weight percent to about 4 weight percent of an antimicrobial agent, based on the weight of said primary treatment composition; and b)ii) from about 5 weight percent to about 20 weight percent of a fluorochemical textile treating agent, based on the weight of said primary treatment composition;

c) drying the topically treated fabric at an elevated temperature to obtain a primarily treated fabric.

2. The treated fabric of claim 1 wherein both sides of said untreated fabric are treated with said primary treatment composition.

3. The treated fabric of claim 1 wherein said primary treatment composition further comprises a crosslinkable resin in an amount of from 0.1 weight percent to about 3 weight percent, based on the weight of said primary treatment composition.

4. The treated fabric of claim 3 wherein said crosslinkable resin comprises a melamine/formaldehyde resin.

5. The treated fabric of claim 3 wherein said primary treatment composition further comprises water in an amount of from about 70 weight percent to about 95 weight percent, based on the weight of said primary treatment composition.

6. The treated fabric of claim 1 wherein the process of preparing said fabric further comprises:

d) applying to one side of said primary treated fabric, an aqueous secondary treatment composition comprising:

d)i) a copolymer latex in an amount of from about 40 weight percent to about 70 weight percent, based on the weight of said secondary treatment composition, said secondary copolymer being an acrylate copolymer having a glass transition temperature of less than 0° C.;

d)ii) from about 0.1 weight percent to about 2 weight percent of an antimicrobial agent, based on the weight of said secondary treatment composition; and d)iii) from about 4 weight percent to about 20 weight percent of a fluorochemical textile treating agent, based on the weight of said secondary treatment composition;

e) drying the secondary composition treated fabric at an elevated temperature to obtain a multi-treated fabric.

7. The treated fabric of claim 6 wherein said secondary treatment composition further comprises:

d)iv) a detackifying wax.

8. The treated fabric of claim 7 wherein said secondary treatment composition further comprises:

d)v) a detackifying filler.

9. The treated fabric of claim 8 wherein said secondary treatment composition further comprises:

d)vi) a crosslinkable melamine/formaldehyde resin.

10. A water repellant and stain resistant textile fabric, comprising:

a) a fabric; and b) the cured product of a primary treatment composition comprising from about 0.25 weight percent to about 4 weight percent of an antimicrobial agent, based on the weight of said primary treatment composition, and from about 5 weight percent to about 20 weight percent of a fluorochemical textile treating agent, based on the weight of said primary treatment composition.

11. The fabric of claim 10 wherein said primary treatment composition is located on both sides of said fabric.

12. The fabric of claim 10 wherein said primary treatment composition further comprises a crosslinkable resin in an amount of from 0.1 weight percent to about 3 weight percent, based on the weight of said primary treatment composition.

13. The fabric of claim 12 wherein said primary treatment composition further comprises water in an amount of from about 70 weight percent to about 95 weight percent, based on the weight of said primary treatment composition.

14. The fabric of claim 10, further comprising on one side of said fabric, a secondary coating c) applied over said primary treatment composition, said secondary coating comprising the cured product of a secondary aqueous treatment composition comprising:

c)i) a copolymer latex in an amount of from about 40 weight percent to about 70 weight percent, based on the weight of said secondary treatment composition, said copolymer being an acrylate copolymer having a glass transition temperature of less than 0° C.;

c)ii) from about 0.1 weight percent to about 2 weight percent of an antimicrobial agent, based on the weight of said secondary treatment composition; and c)iii) from about 4 weight percent to about 20 weight percent of a fluorochemical textile treating agent, based on the weight of said secondary treatment composition.

15. The fabric of claim 14 wherein said secondary treatment composition further comprises:

c)iv) a detackifying wax.

16. The fabric of claim 15 wherein said secondary treatment composition further comprises:

c)v) a detackifying filler.

17. The fabric of claim 16 wherein said secondary treatment composition further comprises:

c)vi) a crosslinkable melamine/formaldehyde resin.

18. The fabric of claim 14 wherein said fabric is a woven fabric.

19. The fabric of claim 14 wherein said fabric is a jacquard.

20. The treated fabric of claim 2 wherein said primary treatment composition penetrate through said fabric and cover the interstitial spaces within said fabric.

21. The fabric of claim 11 wherein said primary treatment composition penetrate through said fabric and cover the interstitial spaces within said fabric.

22. A process for the preparation of the treated fabric of claim 6, comprising:

a) topically treating said untreated fabric with an aqueous primary treatment composition comprising:

a)i) from about 0.25 weight percent to about 4 weight percent of an antimicrobial agent, based on the weight of said primary treatment composition; and a)ii) from about 5 weight percent to about 20 weight percent of a fluorochemical textile treating agent, based on the weight of said primary treatment composition;

b) drying the topically treated fabric at an elevated temperature to obtain a primarily treated fabric;

c) applying to one side of said primarily treated fabric, a secondary aqueous treatment composition comprising:

c)i) a copolymer latex in an amount of from about 40 weight percent to about 70 weight percent, based on the weight of said secondary treatment composition, said secondary copolymer being an acrylate copolymer having a glass transition temperature of less than 0° C.;

c)ii) from about 0.1 weight percent to about 2 weight percent of an antimicrobial agent, based on the weight of said secondary treatment composition; and c)iii) from about 4 weight percent to about 20 weight percent of a fluorochemical textile treating agent, based on the weight of said secondary treatment composition; and d) drying the secondary composition treated fabric at an elevated temperature to obtain a multi-treated fabric.

* * * * *

UNITED STATES PATENT AND TRADEMARK OFFICE

CERTIFICATE OF CORRECTION

PATENT NO. : 6,207,250 B1
DATED : March 27, 2001
INVENTOR(S) : Craig A. Rubin et al.

It is certified that error appears in the above-identified patent and that said Letters Patent is hereby corrected as shown below:

Column 1,
Lines 1-4, The words "This application is a continuation-in-part of U.S. patent application Ser. No. 08/687,527, filed Aug. 7, 1996, entitled "Treated Textile Fabric", which is hereby incorporated by reference." should be change to -- This application is a continuation-in-part of U.S. patent application Ser. No. 08/687,527, which was the national stage of International application No. PCT/US95/03566, filed March 21, 1995, entitled "Water-Resistant and Stain-Resistant, Antimicrobial Treated Textile Fabric", now U.S. patent No. 6,024,823, which is hereby incorporated by reference. --

Signed and Sealed this

Twenty-fifth Day of December, 2001

*Attest:*

*Attesting Officer*

JAMES E. ROGAN
*Director of the United States Patent and Trademark Office*